United States Patent [19]

Koike

[11] 4,016,791

[45] Apr. 12, 1977

[54] AUTOMATIC RHYTHM PLAYING APPARATUS

[75] Inventor: Masahiko Koike, Hamamatsu, Japan

[73] Assignee: Nippon Gakki Seizo Kabushiki Kaisha, Hamamatsu, Japan

[22] Filed: Feb. 25, 1975

[21] Appl. No.: 552,733

[30] Foreign Application Priority Data

Mar. 2, 1974 Japan ..... 49-24678
May 31, 1974 Japan ..... 49-63008

[52] U.S. Cl. ..... 84/1.03; 84/1.24
[51] Int. Cl.[2] ..... G10F 1/00
[58] Field of Search ..... 84/1.01, 1.03, 1.24, 84/DIG. 12

[56] References Cited

UNITED STATES PATENTS 3,549,776 12/1970 Shiga et al. ..... 84/1.03
3,637,914 1/1972 Hiyama ..... 84/1.03

*Primary Examiner*—Ulysses Weldon
*Attorney, Agent, or Firm*—Spensley, Horn & Lubitz

[57] ABSTRACT

An automatic rhythm producing apparatus is capable of emphasizing a rhythm pattern of a desired percussion instrument among a plurality of rhythm patterns which constitute a rhythm. The rhythm producing apparatus has a pulse level control circuit for controlling the pulse level of a selected rhythm pattern signal among a plurality of rhythm pattern signals. This circuit is provided between a rhythm pattern forming circuit and a rhythm selection circuit. The apparatus also comprises control means for controlling the output of the rhythm selection circuit to prevent variation in the average level of the entire rhythm sound. Another example of the inventive apparatus further discloses means for controlling power voltage in a frequency dividing circuit.

6 Claims, 5 Drawing Figures

AUTOMATIC RHYTHM PLAYING APPARATUS

BACKGROUND OF THE INVENTION

1. Field of the Invention

This invention relates to an automatic rhythm playing apparatus and, more particularly, to an automatic rhythm playing apparatus adapted for use with electronic musical instruments.

2. Prior Art

There is a type of automatic rhythm playing apparatus in which clock pulses produced by a clock pulse oscillator are divided in frequency to form different pulses of various pulse periods and these different pulses are suitably combined to produce scores of different rhythm pattern signals in the form of pulse trains. According to this prior art type of apparatus, a desired rhythm sound is sounded by selectively combining these rhythm pattern signals. If, for example, a rhythm of Bosanova, consisting of a bass drum, a cymbal and maracas is desired, a rhythm pattern signals corresponding to the respective percussion instruments are combined to produce the desired rhythm sound. In this prior art apparatus, the level of the rhythm sound to be sounded is adjustable as a whole but it is not possible to adjust the level of each component percussion instrument sound independently from each other. This naturally leads to monotonousness in the rhythm sound produced and therefore is unsatisfactory from the standpoint of realizing an ideal simulation of a natural rhythm sound.

BRIEF SUMMARY OF THE INVENTION

It is, therefore, an object of this invention to provide an automatic rhythm producing apparatus capable of producing a desired rhythm sound consisting of several percussion instruments among which a tone of a desired percussion instrument is emphasized and thereby providing the audience with feeling of a closer simulation of a natural rhythm sound.

It is another object of this invention to provide an automatic rhythm producing apparatus capable of producing the above described rhythm sound without causing variation in the average level of the rhythm sound as a whole notwithstanding emphasis placed on a particular sound of a selected percussion instrument.

BRIEF DESCRIPTION OF THE DRAWINGS

The invention will now be described in detail with reference to the accompanying drawings in which.

DETAILED DESCRIPTION OF THE INVENTION

Figure 1:
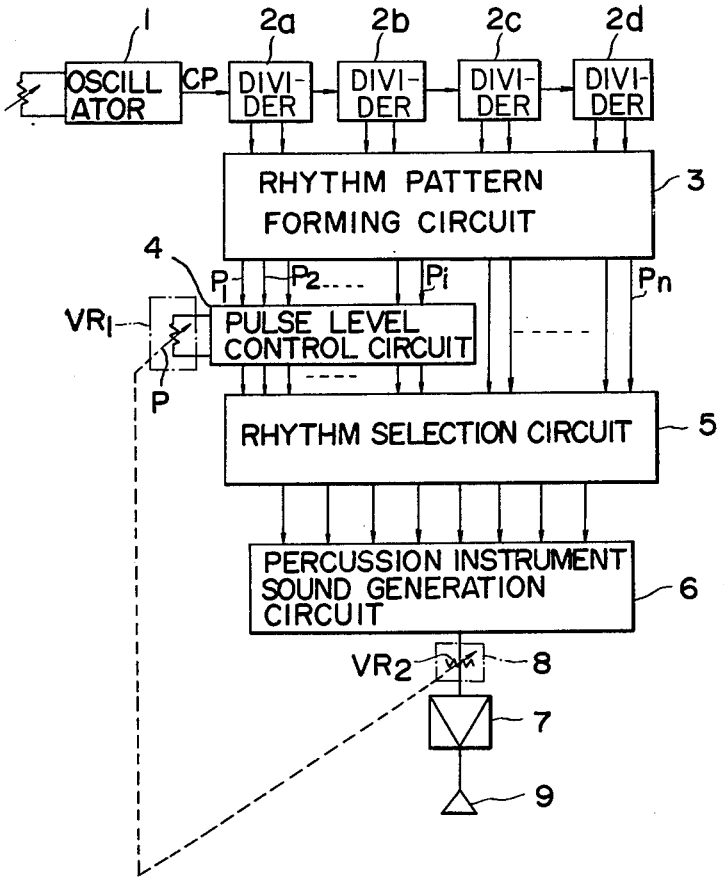
FIG. 1 is a block diagram showing one preferred embodiment of the present invention.

Referring first to FIG. 1, a clock pulse oscillator 1 produces clock pulses CP used for producing a tempo in a desired rhythm sound. The oscillator 1 is adapted to control the tempo by changing the oscillation frequency. The clock pulses CP are applied to multi-stage ½ frequency dividing circuits 2*a*–2*d*. The frequency dividing circuit 2*a* to which the clock pulses CP are initially applied produces an output divided in frequency by two and each of the subsequent frequency dividing circuits 2*b*–2*d* receives the output of the frequency dividing circuit of the immediately previous stage and produces an output divided in frequency by two.

A rhythm pattern forming circuit 3 is provided for forming predetermined rhythm pattern signals corresponding to the outputs of the frequency dividing circuit 2*a*–2*d*. Several scores of different rhythm pattern signals $P_1$–$P_n$ are output from the rhythm pattern forming circuit 3 in the form of separate pulse trains. The circuit 3 is constructed of a diode matrix circuit or a read-only memory which is known per se.

A plurality of rhythm pattern signals $P_1$–$P_i$ selected from the rhythm pattern signals $P_1$–$P_n$ are applied to a pulse level control circuit 4 and the rest of the rhythm pattern signals are directly applied to a rhythm selection circuit 5.

Figure 2:
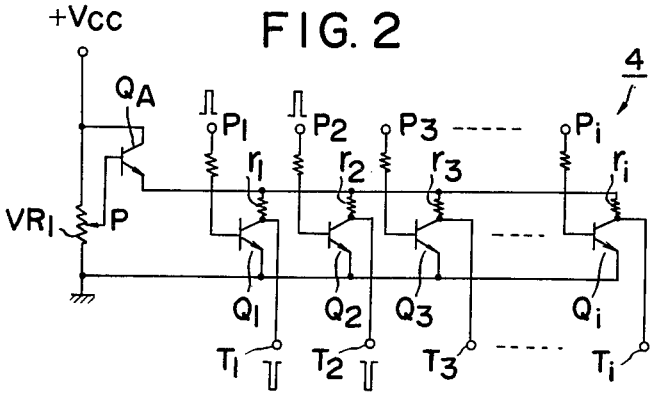
FIG. 2 is a circuit diagram showing an example of a pulse level control circuit provided in the inventive apparatus.

The pulse level control circuit 4 is capable of variably controlling levels of the input pulses, i.e. the rhythm pattern signals, by operation of a variable resistor $VR_1$. An example of the pulse level control circuit 4 is shown in FIG. 2. The output from slider P of a variable resistor $VR_1$ is applied to the base of a transistor $Q_A$. The voltage at the base of the transistor $Q_A$ can be varied by changing voltage dividing ratio in the variable resistor $VR_1$. Accordingly, an emitter voltage which varies in accordance with the variation in the base voltage is applied to transistors $Q_1$–$Q_i$ as a source of voltage and signals the levels of which vary with the variation of the base voltage are produced from output terminals $T_1$–$T_i$ through resistors $r_1$ – $r_i$. Since the rhythm pattern signals $P_1$ – $P_i$ are applied to the bases of the transistors $Q_1$ – $Q_i$ which thereby become conductive, the levels at the output terminals $T_1$ – $T_i$ become zero.

It should be noted that the transistors $Q_1$ – $Q_i$ are used as switching elements and operation in saturation region regardless of the magnitude of the level of the pulse applied to their base. Accordingly, the output level at the output terminals $T_1$ – $T_i$ is not affected by the magnitude of the levels of the rhythm pattern signals $P_1$ – $P_i$ produced by the rhythm pattern forming circuit 3 but depends upon variation in the collector voltage of the transistors $Q_1$ – $Q_i$ which is controlled by the variable resistor $VR_1$. If the base voltage of the transistor $Q_A$ controlled by the variable resistor $VR_1$ is high, the pulse level of the output from the output terminals $T_1$ – $T_i$ is high and the pulse level of the output rhythm pattern signals is deep (high). If the base voltage is low, the pulse level of the rhythm pattern signals output from the output terminals $T_1$ – $T_i$ is low. Thus, the pulse level of the rhythm pattern signals is controlled in the pulse level control circuit 4. The rhythm pattern signals controlled in their level are thereafter applied to a rhythm selection circuit 5.

The rhythm selection circuit 5 which is known per se is adapted to select several kinds of desired rhythm pattern signals such, for example, as waltz, tango and bosanova from among the rhythm pattern signals $P_1$ – $P_n$ in response to operation of a rhythm selection switch (not shown) and apply these selected rhythm pattern signals to a percussion instrument sound generation circuit 6.

The percussion instrument sound generation circut 6 is provided for producing predetermined percussion instrument sound signals (e.g. bass drum, cymbal, maracas etc.) corresponding to the rhythm pattern signals supplied from the rhythm selection circuit 5. Accordingly, the percussion instrument sound signals produced by this circuit 6 correspond to the selected rhythm patterns and the pulse level of each percussion instrument sound is determined by the level of the corresponding rhythm pattern signal. The levels of the respective percussion instrument sounds are therefore controlled by controlling the pulse levels of the corresponding rhythm patterns. The percussion instrument sound signal generated in the circuit 6 are synthesized into a single rhythm sound and thereafter is amplified in an amplifier 7 and sounded through suitable means such as a speaker 9.

Assume that there is a rhythm composed of the rhythm pattern signals $P_1$ and $P_n$ and that the signal $P_1$ corresponds to a sound of cymbal while the signal $P_n$ corresponds to a sound of maracas. If the pulse level is controlled in the pulse level control circuit 4 so that it will be increased a rhythm sound in which the sound of cymbal is emphasized is produced. Assume again that a rhythm sound consists of rhythm pattern signals $P_1$, $P_2$ and $P_n$ and that the signal $P_1$ corresponds to a sound of bass drum, $P_2$ to a sound of maracas and $P_n$ to a sound of conga. If the pulse level in the pulse level control circuit 4 is controlled so that it will become low, a rhythm sound in which the bass drum and maracas sounds are weaker than the conga sound is produced.

It will be understood from the foregoing that level of one or more percussion instruments among a rhythm sound can be variably controlled as desired by supplying corresponding rhythm pattern signal or signals to the rhythm selection circuit 5 through the pulse level control circuit 4.

In the foregoing example, there is a problem that pulse level control in the pulse level control circuit 4 inevitably causes variation in the entire rhythm tone. For the purpose of overcoming this problem, a counter-interlocking control circuit 8 is provided on the output side of the percussion instrument sound generation circuit 6. This circuit 8 performs a control operation in a counter-interlocking relationship to the variable resistor $VR_1$ in the pulse level control circuit 4. As an example of this circuit 8, a variable resistor $VR_2$ having a slider which moves in an interlocking relationship to the slider P of the variable resistor $VR_1$ may be employed. According to this arrangement, as the pulse level decreases by operation of the variable resistor $VR_1$, the entire level of the rhythm sound signal output from the percussion instrument sound generation circuit 6 increases owing to the counter-interlocking operation of the variable resistor $VR_2$. Similarly, if the pulse level increases, the entire level of the rhythm tone signal decreases. Thus, the entire level of the output rhythm sound signal is always maintained at a predetermined value.

Figure 3:
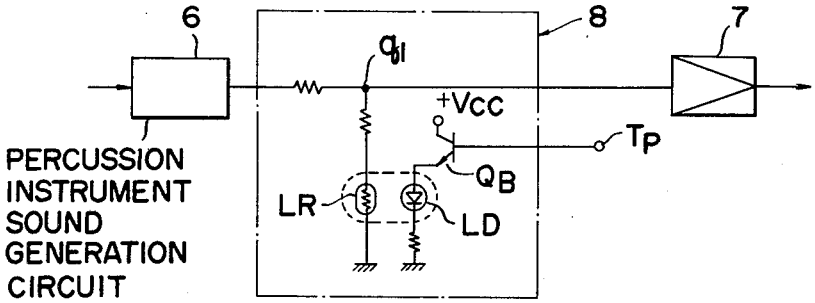
FIG. 3 is a circuit diagram showing an example of a counter-interlocking control circuit.

As the circuit 8, not only a mechanical device such as the variable resistor $VR_2$ but an electronic type of circuit such as shown in FIG. 3 may be employed. In this electronic type of circuit, voltage at the slider P (i.e. voltage equivalent to the base voltage of the transistor $Q_A$) is applied to the gate terminal $T_p$ of a transistor $Q_B$.
b As the base voltage increases by operation of the variable resistor $VR_1$ resulting in increase in the level of the pulse output from the pulse level control circuit 4, current supplied to a light-emitting diode LD which is connected to the emitter of the transistor $Q_B$ increases. This increases luminance of the diode LD and thereby decreases resistance of a photoconductive element LR due to photoconductive effect. Accordingly, potential at a point $q_1$ drops and the entire level of the rhythm sound signal supplied from the percussion instrument sound generation circuit 6 to the amplifier 7 decreases. If the variable resistor $VR_1$ is operated to decrease the level of the pulse output from the pulse level control circuit 4, the entire level of the rhythm sound signal increases. Thus, the rhythm sound is constantly maintained at a predetermined level.

Figure 4:
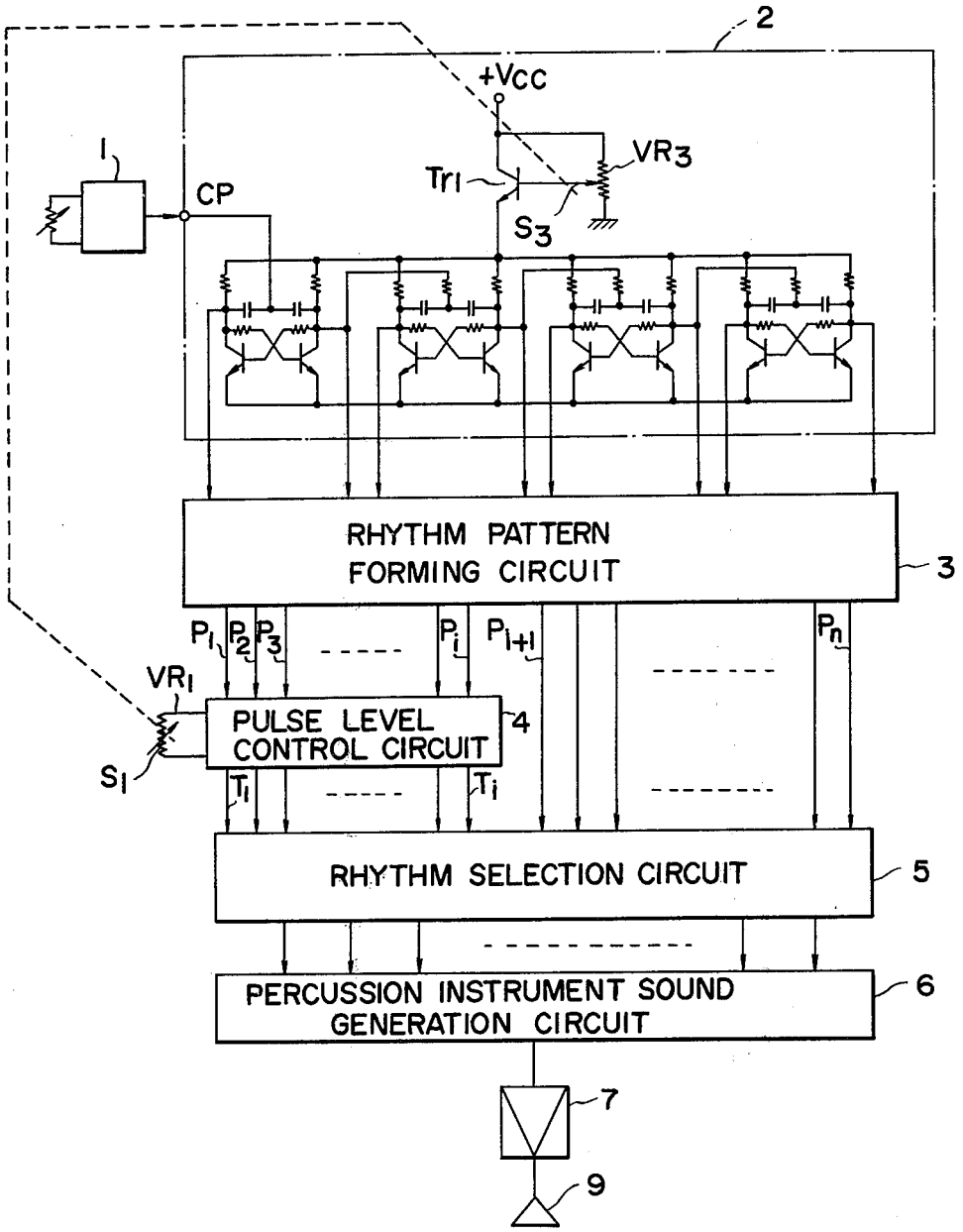
FIG. 4 is a block diagram showing another embodiment of the invention.

FIG. 4 shows another embodiment of this invention. This embodiment is different from the embodiment shown in FIG. 1 in that the counter-interlocking circuit 8 is replaced by a circuit which causes the power voltage of the frequency dividing circuit 2 to vary in a counter-interlocking relationship to the operation of a variable resistor $VR_3$.

In the embodiment shown in FIG. 4, the pulse level of the rhythm pattern signals $P_1 - P_i$ is controlled by the pulse level control circuit 4, whereas the pulse level of the other rhythm pattern signals $P_{i+1} - P_n$ is controlled by the frequency dividing circuit 2.

The frequency dividing circuit 2 is so constructed that the pulse level of the frequency divided outputs can be controlled by varying the level of the voltage applied to each of component flip-flop circuits. The transistor $Tr_1$ is controlled by applying the output of the slider $S_3$ of the variable resistor $VR_3$ to the base of the transistor $Tr_1$ and thereby variably controlling voltage dividing ratio of the variable resistor $VR_3$. The source of voltage $V_{cc}$ is applied to the respective flip-flop circuits through the transistor $Tr_1$. An emitter voltage which varies with the base voltage is applied to the respective flip-flop circuits as their power voltage. Accordingly, the pulse level of the frequency divided outputs, and, consequently, the pulse level of the respective rhythm pattern signals $P_1 - P_n$ output from the rhythm pattern forming circuit 3, is controlled in accordance with the variation in the base voltage of the transistor $Tr_1$. Thus, the pulse level of the rhythm pattern signals $P_{i+1} - P_n$ applied directly to the rhythm selection circuit 5 is variably controlled in accordance with the variation in the base voltage of the transistor $Tr_1$.

The pulse level of the rhythm pattern signals $P_1 - P_i$ is controlled by the pulse level control circuit 4 in the same manner as has previously been described. Since the variable resistor $VR_1$ operates in a counter-interlocking relationship to the variable resistor $VR_3$, the level of the rhythm pattern signals $P_{i+1} - P_n$ increases and decreases as the level of the rhythm pattern signals $P_1 - P_i$ from the pulse level control circuit 4 decreases and increases. More specifically, if the base voltage controlled by the variable resistor $VR_1$ is high, the level of the outputs from output terminals $T_1 - T_i$ is high and the pulse level of the output rhythm pattern signals is high. On the other hand, the base voltage of the transistor $Tr_1$ is low and the pulse level of the output of the frequency dividing circuit 2 is low because the variable resistor $VR_3$ operates in a counter-interlocking relationship to the variable resistor $VR_1$. Accordingly, the pulse level of the rhythm pattern signals $P_{i+1} - P_n$ decreases as the pulse level of the rhythm pattern signals output from the pulse level control circuit 4 increases.

If the base voltage of the transistor $Q_A$ controlled by the variable resistor $VR_1$ is low, the pulse level of the rhythm pattern singals output from the output terminals $T_1 - T_i$ is low. In the meanwhile, the pulse level of the rhythm pattern signals $P_{i+1} - P_n$ increases as the rhythm pattern signals output from the pulse level control circuit 4 decreases.

If no emphasis is required on any component sound of the rhythm sound, the sliders $S_1$, $S_3$ of the variable resistors $VR_1$, $VR_3$ are set at a neutral position. This equalizes the levels of all of the rhythm pattern signals of the rhythm sound and no emphasis is placed on any of the component sounds.

Assume, for example, that there is a rhythm consisting of a cymbal sound and maracas sound and the rhythm pattern signal $P_1$ corresponds to the cymbal sound and the rhythm pattern signal $P_n$ corresponds to the maracas sound. If emphasis is to be placed on the cymbal sound, the pulse level control circuit 4 is operated so that the pulse level increases. This decreases the power voltage of the respective flip-flop circuits of the frequency dividing circuit 2 with a result that the cymbal sound is sounded with a strong beat and the maracas sound with a weak beat. If, conversely, the maracas sound is to be emphasized, the pulse level control circuit is operated in the opposite manner and the maracas sound with a strong beat and the cymbal sound with a weak beat are sounded. Strength of beats can be adjusted as desired by suitably operating the variable resistors $VR_1$ and $VR_3$.

It will be understood from the foregoing that strength of one beat varies substantially inversely with strength of the other beat so that the level of the rhythm sound as a whole is maintained at a substantially constant value and no unnatural variation in the entire level occurs.

Figure 5:
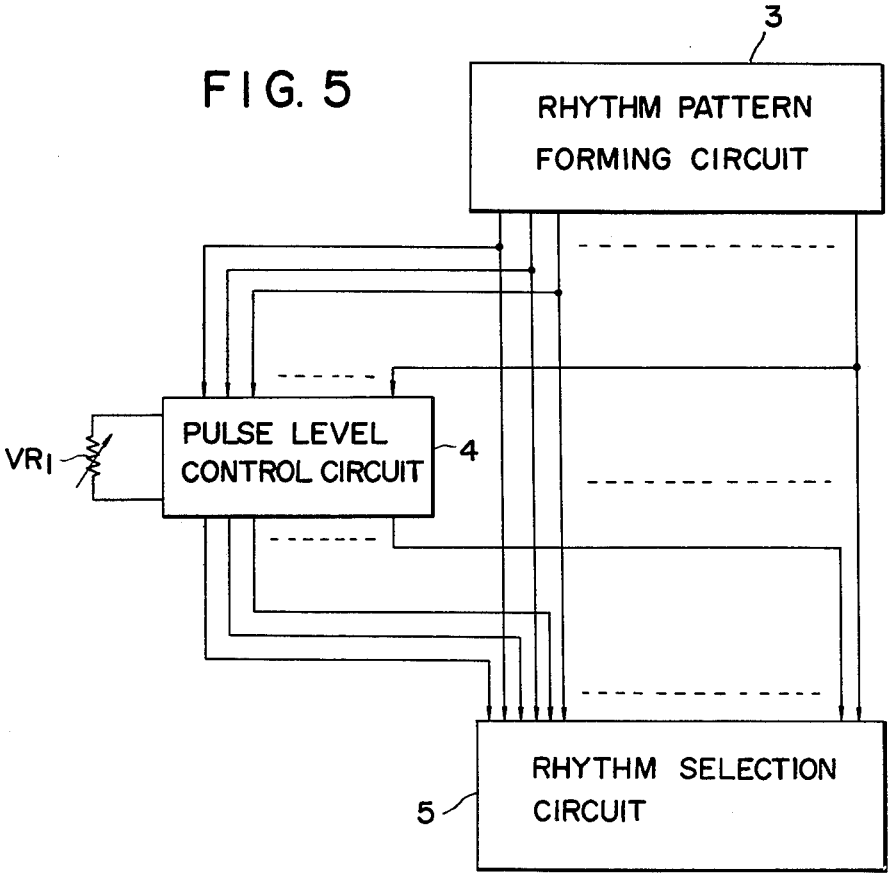
FIG. 5 is a block diagram showing another example of connection between the rhythm pattern forming circuit, the pulse level control circuit and the rhythm selection circuit.

Instead of applying desired set of rhythm pattern signals to the pulse level control circuit 4, all of the outputs of the rhythm pattern forming circuit 3 may be applied to the pulse level control circuit 4 as shown in FIG. 5. In this case, the outputs of the rhythm pattern forming circuit 3 are also applied to the rhythm selection circuit 5 where these outputs of the circuit 3 and the outputs of the control circuit 4 are properly selected.

What is claimed is:

1. An automatic rhythm producing apparatus comprising:

a rhythm pattern forming means for producing a plurality of rhythm pattern signals in the form of pulse trains;

a pulse level control circuit for variably controlling the pulse level of one or more predetermined rhythm pattern signals supplied thereto among the output rhythm pattern signals of said rhythm pattern forming means;

a rhythm selection circuit for selecting and outputting a particular rhythm pattern signal or signals from said level control circuit and said rhythm pattern forming means;

a percussion instrument sound generation circuit for producing, in response to the output signals from said rhythm selection circuit, a desired rhythm sound signal; and a means for controlling the entire level of said rhythm sound signal, said means responsive to and operating in counter interlocking relationship with said level control circuit such that when said pulse level of one or more predetermined rhythm pattern signals is varied by said pulse level control circuit, said level of said rhythm sound signal is varied inversely.

2. An automatic rhythm producing apparatus as defined in claim 1 which further comprising:

means for sounding the desired rhythm sound upon receipt of the output signals from said percussion instrument sound generation circuit; and in which said rhythm pattern forming means comprise:

a clock pulse oscillator, a frequency dividing circuit for successively dividing the frequency of the clock pulse, and a rhythm pattern forming circuit for producing a plurality of rhythm pattern signals is response to the output from said frequency dividing circuit.

3. An automatic rhythm producing apparatus as defined in claim 1 wherein said pulse level control circuit comprises:

one or more transistors provided for a control purpose, each of said transistors having one of said rhythm pattern signals supplied to a control electrode of said transistor whereby said transistor becomes conductive upon receipt of said rhythm pattern signal; and a variable resistor coupled to a source of electrical power and to said transistors for variably controlling the level of the voltage supplied to said transistors.

4. An automatic rhythm producing apparatus as defined in claim 2 wherein said means for controlling the entire level of the rhythm sound is a variable resistor which is coupled respectively between said percussion instrument sound generation circuit and said means for sounding the rhythm sound and operates in a counter-interlocking relationship to the variable resistor of said pulse level control circuit.

5. An automatic rhythm producing apparatus as defined in claim 3 wherein said means for controlling the entire level of the rhythm sound comprises:

a light-emitting diode, said light emitting diode being coupled to said variable resistor and emitting light which varies with the level of the voltage of said transistors provided for said control purpose, and a photo conductive element disposed adjacent to said light emitting diode and between said percussion sound generation circuit and said means for sounding the rhythm sound, said photoconductive element having a resistance which varies inversely with the luminance of said light emitting diode.

6. An automatic rhythm producing apparatus as defined in claim 2 wherein said means for controlling the entire level of the rhythm sound comprises a means for varying the level of the voltage of said frequency dividing circuit.

* * * * *